US007690862B2

(12) United States Patent
Szekely

(10) Patent No.: US 7,690,862 B2
(45) Date of Patent: Apr. 6, 2010

(54) QUICK CONNECT TRANSIT BOARDING PLATFORM PANEL

(75) Inventor: Kenneth E. J. Szekely, Oakville (CA)

(73) Assignee: Astra Capital Incorporated, Oakville, Ontario (CA)

( * ) Notice: Subject to any disclaimer, the term of this patent is extended or adjusted under 35 U.S.C. 154(b) by 754 days.

(21) Appl. No.: 11/252,835

(22) Filed: Oct. 18, 2005

(65) Prior Publication Data

US 2006/0037155 A1 Feb. 23, 2006

Related U.S. Application Data

(63) Continuation-in-part of application No. 11/070,358, filed on Mar. 2, 2005, now Pat. No. 7,000,279, which is a continuation of application No. 10/244,958, filed on Sep. 16, 2002, now Pat. No. 6,895,622, which is a continuation-in-part of application No. 09/609,971, filed on Jul. 3, 2000, now Pat. No. 6,449,790.

(51) Int. Cl.
*E01C 11/24* (2006.01)

(52) U.S. Cl. ..... 404/19; 14/73

(58) Field of Classification Search ..... 404/19, 404/71; 14/73

See application file for complete search history.

(56) References Cited

U.S. PATENT DOCUMENTS

| | | | | |
|---|---|---|---|---|
| 890,436 | A * | 6/1908 | Momberg | 52/506.01 |
| 3,172,508 | A * | 3/1965 | Doering et al. | 52/579 |
| 3,196,763 | A | 7/1965 | Rushton | |
| 3,236,017 | A * | 2/1966 | Doering | 52/579 |
| 3,301,147 | A * | 1/1967 | Clayton et al. | 404/35 |
| 3,310,919 | A * | 3/1967 | Bue et al. | 52/127.11 |
| 3,943,589 | A | 3/1976 | Pedersen | |
| 4,129,673 | A * | 12/1978 | Eigenmann | 428/172 |
| 4,194,330 | A * | 3/1980 | Smith | 52/177 |

(Continued)

FOREIGN PATENT DOCUMENTS

| | | |
|---|---|---|
| NL | 8600855 | 11/1987 |

*Primary Examiner*—Gary S Hartmann
(74) *Attorney, Agent, or Firm*—Volpe and Koenig, P.C.

(57) ABSTRACT

The present invention relates to a transit boarding platform panel for use along an edge of a transit platform adjacent a track. The panel comprises a molded base portion formed from a reinforced composite polymer, and having a top deck and bottom plate, a first side intended to be adjacent a track at an edge of the transit platform, a second side opposite said first side and intended to be adjacent the transit platform, a first end and a second end, and between the top deck and bottom plate a series of internal support members. The top deck has a detectable warning surface consisting of raised truncated domes detectable by the visually impaired in accordance with Americans with Disabilities Act (ADA): Accessibility Guidelines for Buildings and Facilities. The first and second ends are provided with means to interconnect adjacent panels and to secure the panels to the platform. In a preferred embodiment the means to interconnect adjacent panels and to secure the panels to the platform includes a groove provided on the first end of each panel, said groove sized and shaped to accept a corresponding sized and shaped tongue provided on the second end of an adjacent panel. There is also provided an improved method of installing a transit platform with a series of transit boarding platform panels along an edge of said transit platform adjacent a track.

12 Claims, 13 Drawing Sheets

U.S. PATENT DOCUMENTS 4,266,381 A * 5/1981 Deller ..... 52/177
4,443,905 A 4/1984 Kopp
4,453,283 A 6/1984 Fitzgerald-Smith et al.
4,715,743 A 12/1987 Schmanski
5,006,011 A 4/1991 Hiyashi
5,010,614 A 4/1991 Braemert et al.
5,081,946 A 1/1992 Nannig et al.
5,287,649 A 2/1994 Presetele
5,303,669 A 4/1994 Szekely
5,320,790 A * 6/1994 Lowe ..... 264/31
5,328,293 A 7/1994 Keefe
5,444,885 A 8/1995 Hanrahan et al.
5,499,888 A 3/1996 Hawkes
5,587,218 A 12/1996 Betz
5,603,134 A 2/1997 Whipkey et al.
5,775,835 A 7/1998 Szekely
5,794,402 A 8/1998 Dumlao et al.
5,807,021 A 9/1998 Aaron
5,870,789 A 2/1999 Carranza-Aubry
5,901,396 A 5/1999 Ahlskog et al.
5,903,943 A 5/1999 Sherrod
5,924,152 A 7/1999 Maier
6,119,634 A 9/2000 Myrick
6,153,282 A * 11/2000 Dickinson et al. ..... 428/141
6,269,508 B1 8/2001 Younce
6,309,732 B1 10/2001 Lopez-Anido et al.
6,449,790 B1 * 9/2002 Szekely ..... 14/69.5
6,588,160 B1 7/2003 Grossman
6,591,567 B2 7/2003 Hota et al.
6,895,622 B2 * 5/2005 Szekely ..... 14/69.5
7,000,279 B2 * 2/2006 Szekely ..... 14/69.5

* cited by examiner

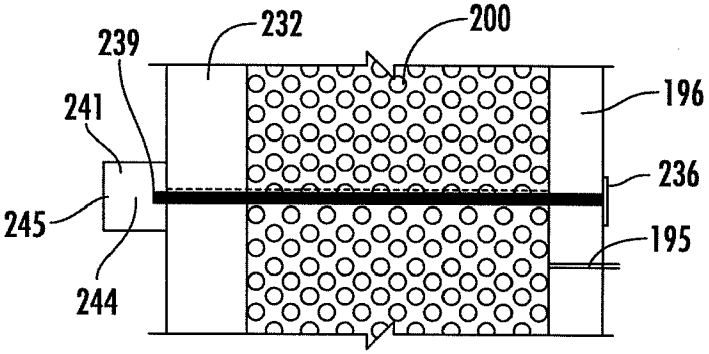
FIG. 18
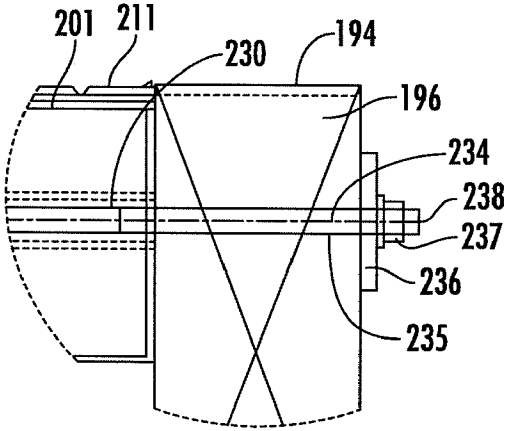
FIG. 19
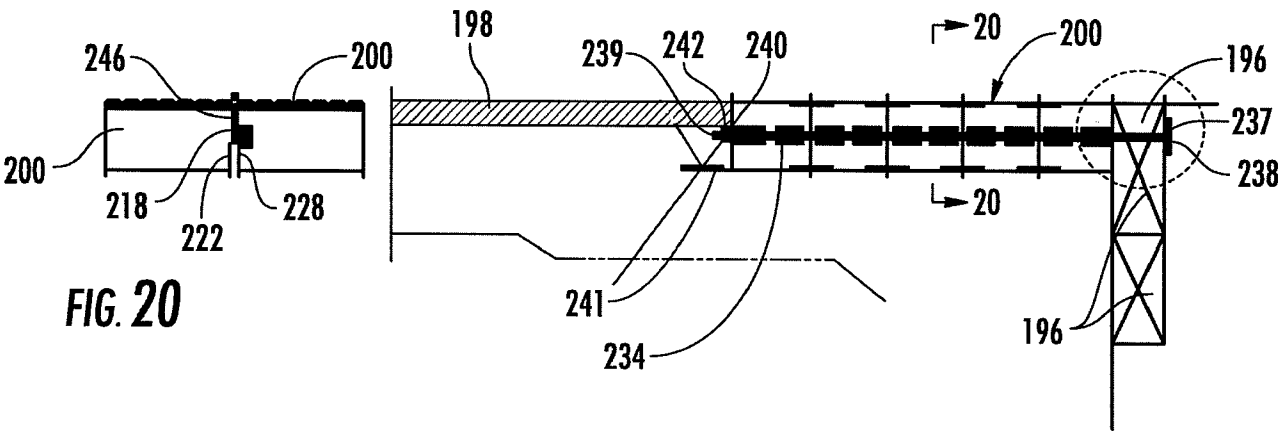
FIG. 17
FIG. 20

QUICK CONNECT TRANSIT BOARDING PLATFORM PANEL

CROSS-REFERENCE TO RELATED APPLICATIONS

This application is a continuation in part of U.S. patent application Ser. No. 11/070,358 filed Mar. 2, 2005 which in turn is a continuation of U.S. patent application Ser. No. 10/244,958 filed Sep. 16, 2002 which in turn is a continuation in part of U.S. patent application Ser. No. 09/609,971 filed Jul. 3, 2000 and which are hereby incorporated by reference.

FIELD OF THE INVENTION

This invention relates to a system for use as transit boarding platform structures. In particular the present invention provides panels to replace pre-cast concrete panels or cast-in-place concrete panels typically used for transit boarding platforms. In a preferred embodiment, the panels of the present invention are formed of reinforced polymer composite materials and incorporate a non-slip walking surface for improved wear and slip resistance.

BACKGROUND OF THE INVENTION

Conventional concrete and wooden transit platforms have a durability problem due to degradation by environmental chemicals such as, salt, urea, acid rain, oils and greases as well as stray electrical currents. This necessitates regular maintenance and periodic replacement of the platforms at considerable cost to transit authorities. Replacement is further complicated with trains going by the platform every few minutes. Steel and concrete are also susceptible to corrosive elements, such as water, salt water and agents present in the environment such as acid rain, road salts, chemicals, oxygen and the like. Environmental exposure of concrete structures leads to pitting and spalling in concrete and thereby results in severe cracking and a significant decrease in strength in the concrete structure. Steel is likewise susceptible to corrosion, such as rust, by chemical attack. The rusting of steel weakens the steel, transferring tensile load to the concrete, thereby cracking the structure. The rusting of steel in stand alone applications requires ongoing maintenance, and after a period of time corrosion can result in failure of the structure. The planned life of steel structures is likewise reduced by rust. Wood, like concrete and steel, is also susceptible to environmental attack, especially rot from weather and termites. In such environments, wood encounters a drastic reduction in strength which compromises the integrity of the structure. Moreover, wood undergoes accelerated deterioration in structures in marine environments.

Concrete transit platforms are typically constructed with the concrete poured in situ as well as using some preformed components pre-cast into structural components such as supports and transported to the site of the construction. Constructing such concrete structures in situ requires hauling building materials and heavy equipment and pouring and casting the components on site. This process of construction involves a long construction time and is generally costly, time consuming, subject to delay due to weather and environmental conditions and the requirement not to disrupt the schedule of trains unduly.

On the other hand, pre-cast concrete structural components are extremely heavy and bulky. Therefore, they are also typically costly and difficult to transport to the site of construction due in part to their bulkiness and heavy weight. Although construction time is shortened as compared to poured in situ, extensive time, with resulting delays, is still a factor. Construction with such pre-cast forms is particularly difficult, if not impossible, in areas with difficult access or where the working area is severely restricted due to adjoining tracks, buildings or platforms. There is a need for a light weight structure to facilitate installation in areas which have difficult access and working area. In addition a lightweight structure could eliminate the costly concrete foundations and steel support systems necessary to support conventional concrete platforms.

There have been solutions proposed for preventing deterioration of steel and concrete bridge and roadway decks. For example U.S. Pat. No. 5,901,396 discloses the use of an aluminum bridge deck to provide light weight and durability. In addressing the limitations of existing concrete, wood and steel structures, some fiber reinforced polymer composite materials have been explored for use in constructing parts of bridges including foot traffic bridges, piers, and decks and hulls of some small vessels. Fiber reinforced polymers have been investigated for incorporation into foot bridges and some other structural uses such as houses, catwalks, and skyscraper towers. These composite materials have been utilized in conjunction with, and as an alternative to, steel, wood or concrete due to their high strength, lightweight and highly corrosion resistant properties. However, construction of load bearing applications built with polymer matrix composite materials have not been widely implemented due to extremely high costs of materials, high assembly costs and uncertain performance, including doubts about long term durability and maintenance. As cost is significant in the public transit industry, such materials have not been considered feasible alternatives for many load bearing traffic designs. For example, high performance composites made with relatively expensive carbon fibers have frequently been eliminated by cost considerations.

U.S. Pat. No. 5,794,402 is directed to a polymer matrix composite modular load bearing deck as a part of a modular structural section for a highway bridge deck. The load bearing deck is formed from a plurality of sandwich panels, each panel having a flat upper surface, a lower surface and a core. The core includes a plurality of trapezoidal, substantially hollow, elongated core members positioned between the upper surface and the lower surface. Each core member has side walls positioned generally adjacent to a side wall of an adjacent core member and are joined together by fasteners, such as bolts and screws, or by adhesives. The assembly time required to fasten the deck together renders the cost prohibitive and impractical for use in a transit platform.

In public transit facilities, such as subway stations and railway stations, there is also a requirement for pedestrians to be able to safely navigate the platform. There is a need for pedestrians to get good traction on the platform to prevent slips and falls in particular on outdoor platforms that can be subject to wind, rain and snow conditions. In addition it is important for pedestrians to be able to detect the location of platform edges so that the pedestrian does not accidentally walk off the edge of the platform. The need for making platform edges detectable is of course particularly acute in attempting to make such facilities accessible and safe for blind or visually impaired persons.

In the 1980's a series of studies were undertaken in the United States to improve the design of buildings and transportation facilities to improve the mobility of the visually impaired. These studies culminated in recommendations on making potential hazards detectable to the visually impaired either by use of the long cane or underfoot.

Americans with Disabilities Act (ADA): Accessibility Guidelines for Buildings and Facilities set the requirements for the use of detectable warnings on inter alia transit platforms to warn visually impaired persons of hazards. The Guidelines require that detectable warnings shall consist of raised truncated domes of prescribed diameter, height and center-to-center spacing and shall contrast visually with adjoining surfaces. Detectable warnings used on interior surfaces are required to differ from adjoining surfaces in resiliency or sound-on-cane contact. Various tactile tiles having raised truncated domes in compliance with the ADA Guidelines or the equivalent have been developed such as those shown in U.S. Pat. Nos. 4,715,743 and 5,303,669. Other tactile surfaces have been proposed such as the rubber on concrete composite tile illustrated in Netherlands Patent 8600855.

U.S. Pat. No. 5,303,669 describes a detectable tactile tile to be installed in concrete or the like. The tiles are illustrated as square with depending flanges projecting downward from the edge of the tile. The flanges have holes through them to assist in anchoring the tile in freshly poured concrete. The holes in the flanges around the perimeter of the tiles permit air to flow out from under the tiles when they are pressed into the concrete. However it is virtually impossible to remove all of the air and there is typically an air space between the bottom surface of the tile and the top of the cured concrete. When baggage carts, money carts with small wheels or heavy mechanical equipment either for cleaning, snow removal etc. passes over the tiles, there may be a tendency for the tiles to crack under the weight of the equipment, due to the air space between tiles and the concrete surface.

U.S. Pat. No. 5,775,835 provides a tactile tile for embedment in fresh concrete on a platform or walking surface. By anchoring the tiles with the concrete through holes in depending flanges the need for adhesives or mechanical fasteners that are labor intensive to install are eliminated or reduced. The bottom surface of the tile is provided with a series of projections. As the tile is being pushed into the concrete, the projections assist in having the concrete flow underneath the tile and as the concrete cures and shrinks slightly the projections remain in contact with the cured surface of the concrete so that the tile is fully supported across its surface. During snow removal or cleaning, the tile will then support the weight of any heavy mechanical equipment and eliminate cracking of the tiles and their necessary replacement. As the fresh concrete cures, an air space forms between the bottom surface and the surface of the cured concrete. This air space prevents the load from equipment moved over the tiles from being transferred to the platform surface resulting in potential damage to the tiles. By incorporating the projections into the bottom surface the loads can be transferred to the platform or walkway surface through the conical standoffs. However the airspace between the concrete surface and the bottom surface is not eliminated resulting in a hollow sound when struck by the cane of a visually impaired person. This distinct sound-on-cane contact between the tiles and the adjoining concrete surface permits the tiles to be used indoors in compliance with the ADA Guidelines. Where the tiles are bonded by an adhesive or mechanically fastened directly to the concrete surface it may not be possible to get a distinctive sound-on-cane contact with a hard material of manufacture such as ceramic, glass reinforced thermosetting resin or vitrified polymer composite and softer resilient rubber or vinyl tiles must be used. In addition use of the projections increases the surface area of the tile that is in contact with the cured concrete that helps resist movement due to thermal expansion etc.

In conventional systems there is also a problem with drainage. Corrosive elements can penetrate past poorly installed or worn sealant joints leading to the deterioration of the steel support structure and concrete foundation.

SUMMARY OF THE INVENTION

It is an object of the invention to provide a transit boarding platform structures to replace pre-cast concrete panels or cast-in-place concrete panels typically used for transit boarding platforms.

It is a further object of the invention to provide transit platform panel formed of reinforced polymer composite materials and incorporating a detectable warning surface in accordance with Americans with Disabilities Act (ADA): Accessibility Guidelines for Buildings and Facilities.

Thus in accordance with the present invention there is provided a transit platform panel comprising a base portion formed from a reinforced composite polymer. The base portion has a top deck and a bottom plate, a first end, a second end, a first side and second side. One or both of the first and second ends is adjacent the edge of the platform. Between the top deck and bottom plate are a series of internal support members. Where the panel comprises the width of the platform the support members are both longitudinal and cross members. In other applications only cross support members are required. The top deck is adapted to have a detectable surface along the first and/or second ends that are adjacent the edge of the platform. Where the panel is the width of the platform, the top deck has a central section and opposite end sections. Detectable warning tiles are mounted to the top surfaces of the end sections. In this application the top surface of the central section has a slip resistant surface. In the preferred embodiment the slip resistant surface consists of a non-slip walking surface coating applied to the top deck. The slip resistant coating should be resistant to the effects of ultraviolet radiation, temperature changes and corrosive elements such as acids, alkalis, salts, phosphates, organic chemicals and solvents such as mineral spirits, gasoline etc. It should also preferably be sufficiently hard to protect against abrasion, chipping, scratching or marring.

Positive drainage, where required, may provided by the top deck being symmetrical about the mid-point line tapering from the mid-point to the ends of the panel to facilitate runoff of any precipitation and prevent standing pools of water. Positive drainage can further be provided by the interface between adjacent panels utilizing a ship-lap configuration with a drainage channel beneath the joint between adjacent panels.

In another embodiment the present invention provides a transit boarding platform panel for use along an edge of a transit platform adjacent a track. The panel comprises a molded base portion formed from a reinforced composite polymer, and having a top deck and bottom plate, a first side intended to be adjacent a track at an edge of the transit platform, a second side opposite said first side and intended to be adjacent the transit platform, a first end and a second end, and between the top deck and bottom plate a series of internal support members. The top deck has a detectable warning surface consisting of raised truncated domes detectable by the visually impaired in accordance with Americans with Disabilities Act (ADA): Accessibility Guidelines for Buildings and Facilities. The first and second ends are provided with means to interconnect adjacent panels and to secure the panels to the platform. In a preferred embodiment the means to interconnect adjacent panels and to secure the panels to the platform includes a groove provided on the first end of each panel, said groove sized and shaped to accept a corresponding sized and shaped tongue provided on the second end of an adjacent panel. There is also provided an improved method of installing a transit platform with a series of transit boarding platform panels along an edge of said transit platform adjacent a track.

Further features of the invention will be described or will become apparent in the course of the following detailed description.

BRIEF DESCRIPTION OF THE DRAWINGS

In order that the invention may be more clearly understood, the preferred embodiments will now be described in detail by way of example, with reference to the accompanying drawings, in which:

FIG. 15A is an enlarged detail of FIG. 15.

FIG. 17 is a schematic partial cross section of a transit boarding platform incorporating the transit boarding platform panel of FIG. 14.

FIG. 18 is a top plan view of the transit boarding platform panel of FIG. 17.

FIG. 19 is an enlarged side plan view of the front side of the transit boarding platform panel of FIG. 17.

FIG. 20 is a schematic partial cross-section of adjoining transit boarding platform panels according to FIG. 17.

DETAILED DESCRIPTION OF THE PREFERRED EMBODIMENT

Figure 1:
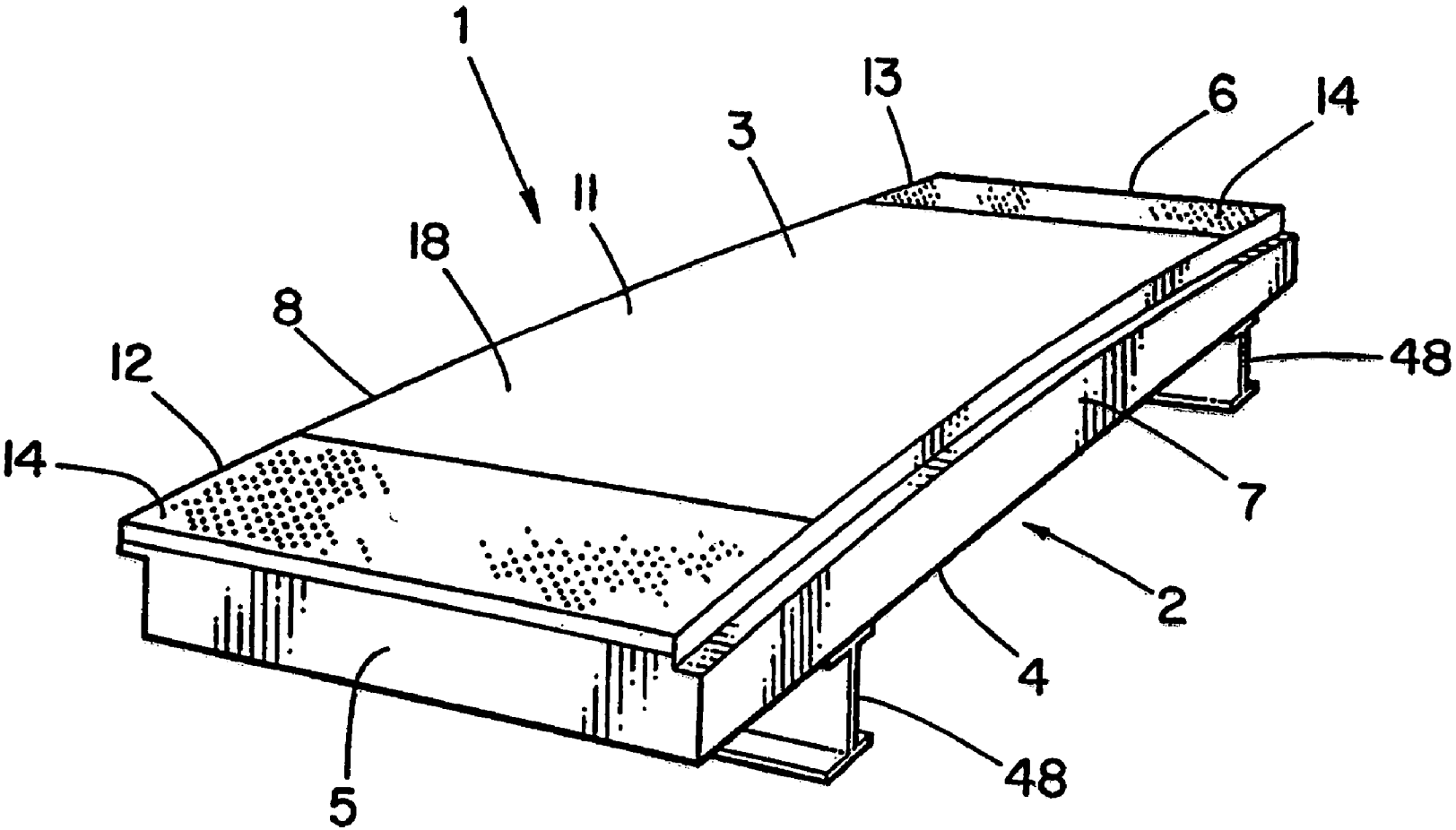
FIG. 1 is a perspective view of one embodiment of a transit boarding platform panel according to the present invention.

Referring to FIGS. 1 to 4 a preferred embodiment of transit boarding platform panel according to the present invention is generally indicated at 1. In the preferred embodiment illustrated the panel 1 comprises a base portion 2 formed from a reinforced composite polymer. The base portion 2 has top deck 3 and bottom plate 4, a first end 5, a second end 6, a first side 7 and second side 8. Between the top deck 3 and bottom plate 4 are a series of internal longitudinal and cross support members 9 and 10 respectively.

The top deck 3 has a central section 11 and end sections 12 and 13. Detectable warning tiles 14 are mounted to the top surfaces 15 and 16 of end sections 12 and 13. The top surface 17 of the central section 11 has a slip resistant coating 18 applied to it. In the preferred embodiment the slip resistant coating 18 consists of a non-slip monolithic walking surface. The slip resistant coating should be resistant to the effects of ultraviolet radiation, temperature changes and corrosive elements such as acids, alkalis, salts, phosphates, organic chemicals and solvents such as mineral spirits, gasoline etc. It should also preferably be sufficiently hard to protect against abrasion, chipping, scratching or marring. A suitable coating is the Diamond Tek™ coating system from Engineered Plastics Inc. of Buffalo, N.Y. The Diamond Tek™ coating can be sprayed on to the top deck 3 of the panel 1 and then fusion bonded. The coating 18 has a depth of about 0.1875 inches.

The detectable warning tiles 14 are similar to the tiles described in U.S. Pat. No. 5,303,669. The tiles, shown in FIGS. 1, 2, 5, 7 and 8, have a horizontal portion 50 adapted to overlie the top surfaces 15 and 16 of the end sections 12 and 13 of the top deck 3 of panel 1 up to the first and second ends 5 and 6, and rear and front edges 51 and 52 respectively, the "front" edge being the one remote from the ends 5 and 6 of panel 1.

Figure 2:
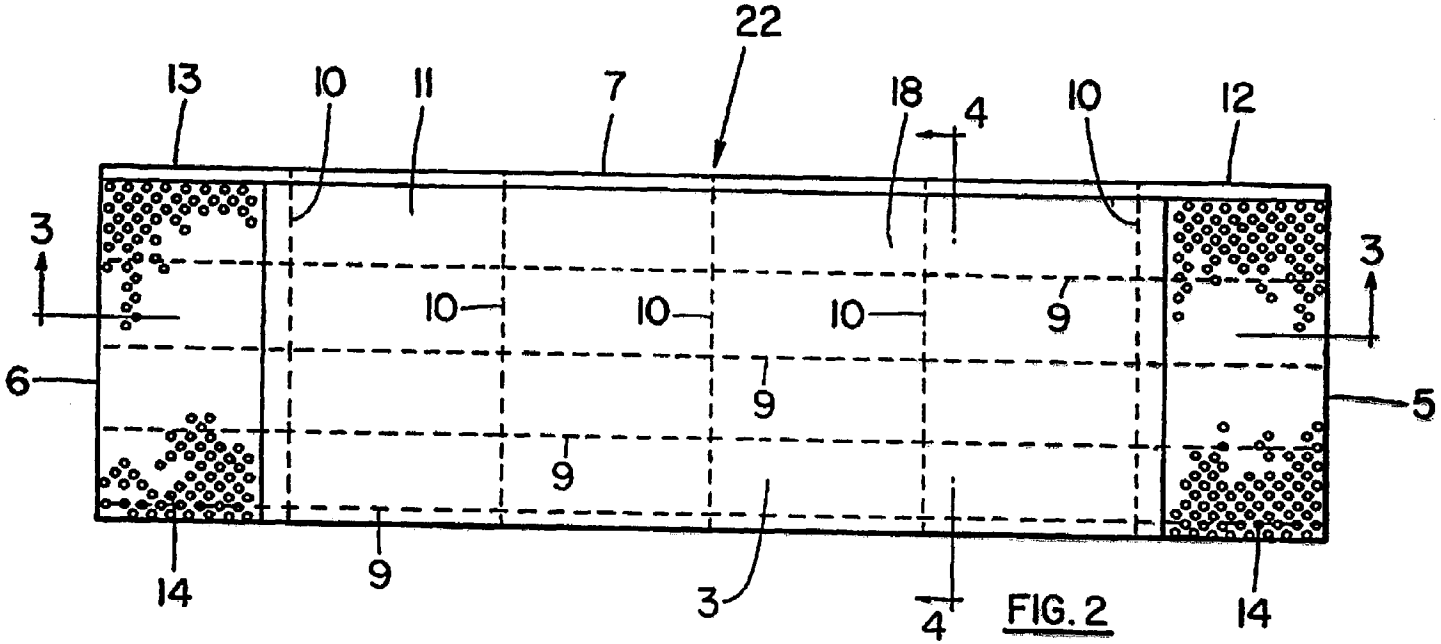
FIG. 2 is a top plan view of the transit boarding platform panel of FIG. 1 showing the position of the internal longitudinal and cross support members in dotted lines.
Figure 3:
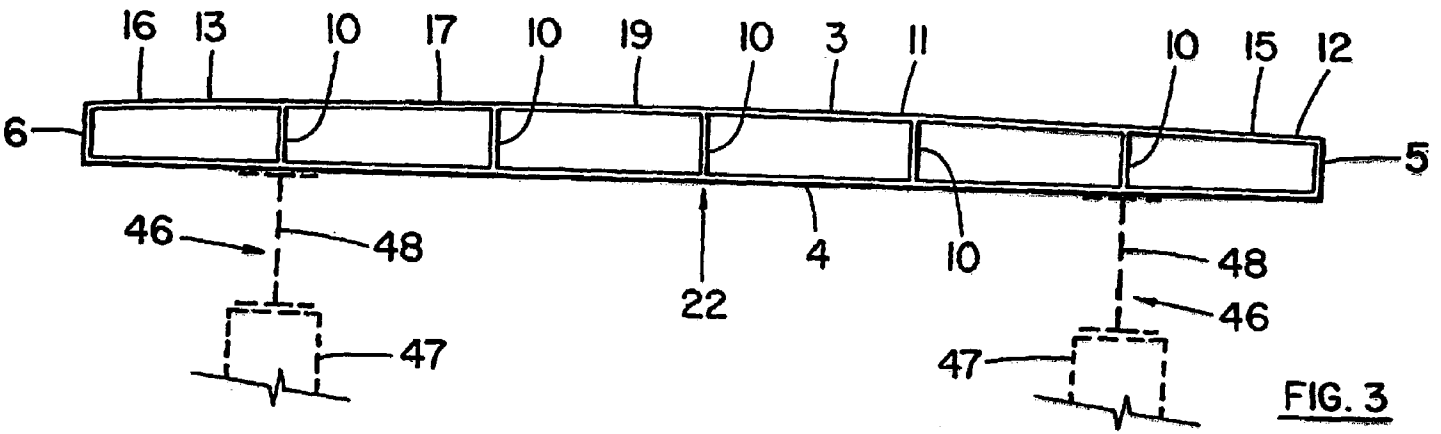
FIG. 3 is a schematic cross section of the transit boarding platform panel of FIG. 2 through line 3-3.

The surface of the horizontal portion 50 has plurality of rows of spaced buttons 53 projecting upwardly therefrom, thereby providing a distinctively textured surface relative to the texture of the surface of the platform. As can be seen in FIGS. 1 and 2, the buttons preferably are circular. Buttons in adjacent rows are offset from each other by one-half of the centerline spacing distance. The buttons 53 have generally flat upper surfaces which have texturing means thereon for creating a palpably rough surface texture. The texturing means in the preferred embodiment is provided by rows of semi-spherical raised dimples arranged in a grid pattern.

The areas between buttons preferably also have texturing means consisting of a plurality of rows of spaced dimples projecting upwardly therefrom, to provide slip resistance in those areas (e.g. for women in high heels and to improve maneuverability of wheelchairs).

Each tile preferably is the entire width of the panel to avoid the need for joints between tiles. The tiles preferably are bonded to the top surface of the end section by the use of a suitable adhesive, such as "Bostic Ultra-Set" (trademark) urethane adhesive. However, for added security, the tiles can also be mechanically fastened to the top deck.

To reduce the possibility of tripping, the height of the buttons in one or more rows adjacent the front edge 52 is reduced in height and diameter relative to the height and diameter of buttons in subsequent rows, so that there is a gradual increase in height and diameter. Thus in the preferred embodiment the buttons in the first row adjacent the front edge 52 are only about one-third as high as the other buttons and the buttons in the second row are only about two-thirds as high as the other buttons. Similarly the buttons in the first row have a diameter about 12% less than the other buttons and the buttons in the second row have a diameter about 3% less than the rest of the buttons.

Figure 5:
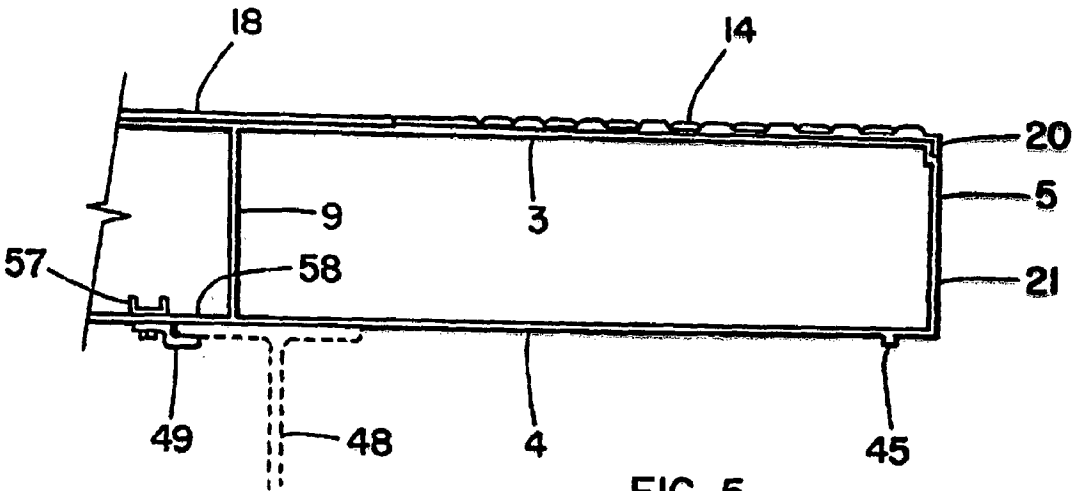
FIG. 5 is an enlarged view of one end of the transit boarding platform panel of FIGS. 2 and 3 showing the means of connection to an underlying support.
Figure 6:
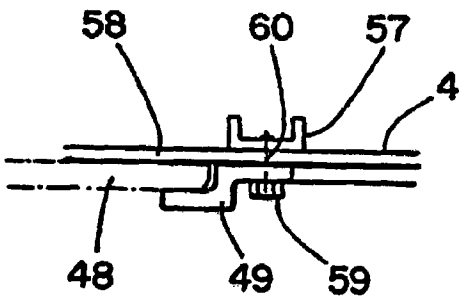
FIG. 6 is an enlarged view of the means of connection to an underlying support shown in FIG. 5.
Figure 7:
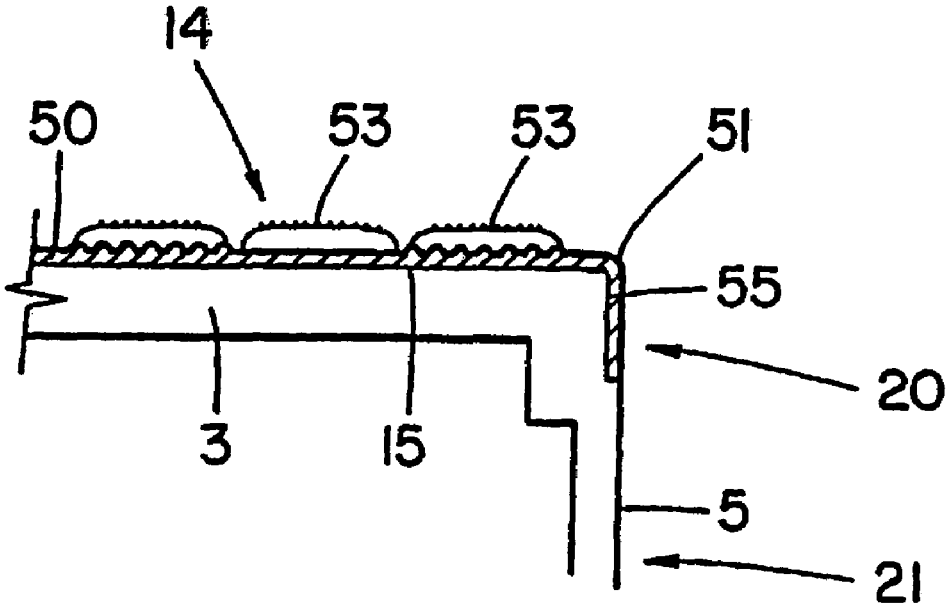
FIG. 7 is an enlarged view in cross section of a top corner of the transit boarding platform panel of FIG. 2.

The tiles 14 preferably have an integral depending flange 55, best seen in FIGS. 5 and 7, adapted to overlie the first and second ends 5 and 6 of the panel and thereby facilitate holding the tile in place. Preferably, an adhesive such as "Bostik Ultra-Set" (trademark) urethane adhesive is used to secure the flange 55 to the ends 5 and 6. The adhesive may be augmented by or replaced by mechanical fastening means. To facilitate a smooth mounting of the tiles the first and seconds 5 and 6 have their top portion 20 offset from the remaining height 21 of the ends 5, 6, the thickness of the depending flange 55 of the tiles 14. The top portion 20 is the length of the depending flange 55.

The tiles can be made of vinyl, rubber, urethane, ceramic or cast composite materials or the like. The edging tile is preferably made entirely of yellow thermoset glass-reinforced plastic composite material having the textured surface pattern as described. In addition, a micro-thin film may be applied to the upper surface if desired, to provide enhanced abrasion resistance characteristics. Because the entire tile preferably is brightly colored, it serves to visually alert sighted and visually impaired pedestrians of the vicinity of the subway platform edge. The textured surface provides a tactile signal as well, which is particularly important for the visually impaired. The buttons can be felt through most if not all footwear, and can also be readily detected by a "white cane" of the type frequently used by the blind or visually impaired. Certain types of conventional canes can detect the buttons very readily, while types may pass between the buttons and can readily detect the dimples in the areas between buttons. It is therefore preferable to have these dimples in the areas between buttons, and not just on the surface of the buttons themselves.

As an alternative to a single bright color, a scheme of alternating contrasting colors could be used to create a distinctive pattern, if desired.

It will be appreciated that a wide range of dimensions may be suitable for the edging tile and for the buttons. However, in the embodiment of the tile shown in the figures, for example, key dimensions are as follows:

| | |
|---|---|
| Forward to rear dimension: | 24.00 inches |
| Tile width: | 47.75 inches |
| Tile thickness: | 0.100 inches |
| Button diameter (base): | 1.325 inches |
| Button diameter (top): | 0.875 inches |
| Button height (excluding dimples) | 0.200 inches |
| Button height (first row from front): | 0.066 inches |
| Button height (second row) | 0.132 inches |
| Spacing of buttons in the same row: (centerline to centerline): | 2.800 inches |
| Spacing of rows (centerline to centerline): | 1.400 inches |

It will be appreciated that the dimensions can be varied widely subject to the ADA Guidelines, as desired to suit the particular application.

Figure 8:
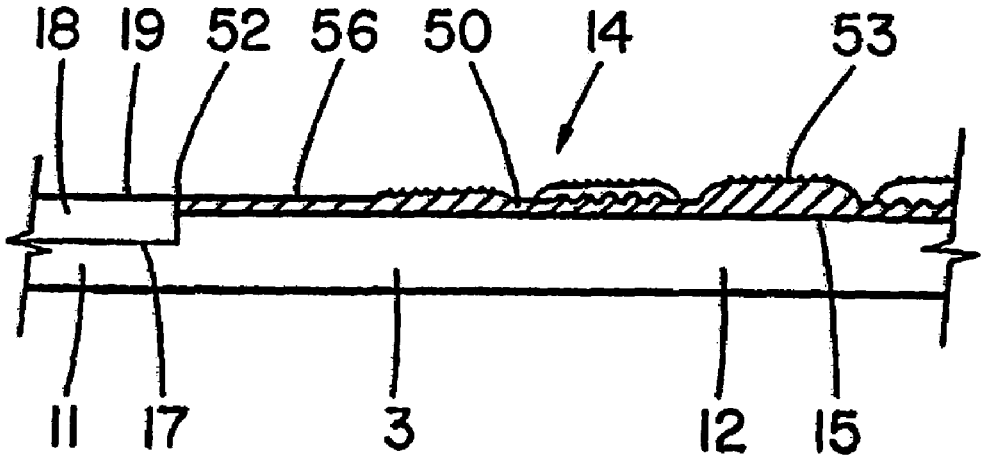
FIG. 8 is an enlarged view in cross section of part of the top surface of the transit boarding platform panel of FIG. 2 showing the interface between the detectable tactile surface and the granite-wearing surface in the preferred embodiment.

As best shown in FIGS. 5 and 8, the top surface 17 of the central section 11 is recessed from the top surfaces 15,16 of end sections 12 and 13 so that the top surface 56 of the tile 14 adjacent its front edge 51 will be flush with the top surface 19 of coating 18. As an alternative to applying the slip resistant coating in the preferred embodiment, the top surface 17 can be flush with the top surface 56 of tiles 14 and a slip resistant surface integrated into the top deck using a grid work of raised dimples etc. Alternatively the surface 17 of the central section 11 of the top deck can be finished with a vinyl, rubber, urethane, ceramic or cast composite materials or the like to provide the desired slip resistance. The minimum friction value established by the ADA Guidelines is 0.6 for accessible routes. The preferred embodiment of the present invention exhibits both wet and dry coefficients of friction close to 1.00 exceeding the minimums required. In addition use of the Diamond Tek™ coating system resulted in abrasion values well above granite floor tiles.

The panel 1 of the preferred embodiment shown in the drawings has nominal dimensions of 15 feet long by about 4 feet in width. The base section 2 has a nominal thickness of between 8 inches at the first and second ends 5,6 and 10 inches along the mid point line 22 of the panel. The top deck 3 is typically symmetrical about the mid-point line tapering from the mid-point to the ends 5, 6 to facilitate runoff of any precipitation and prevent standing pools of water. The weight of the preferred embodiment is about 480 lbs., about one-tenth the weight of standard precast concrete panels currently in use. The panels of the present invention were tested for vibration and load to test the ability of the panel to withstand the uplifting forces caused by passing rail traffic and the load bearing characteristics of the panel. Vibration tests on the preferred embodiment indicated vibration amplitudes below the human threshold of perception and comparable to results for precast concrete platforms.

Figure 4:
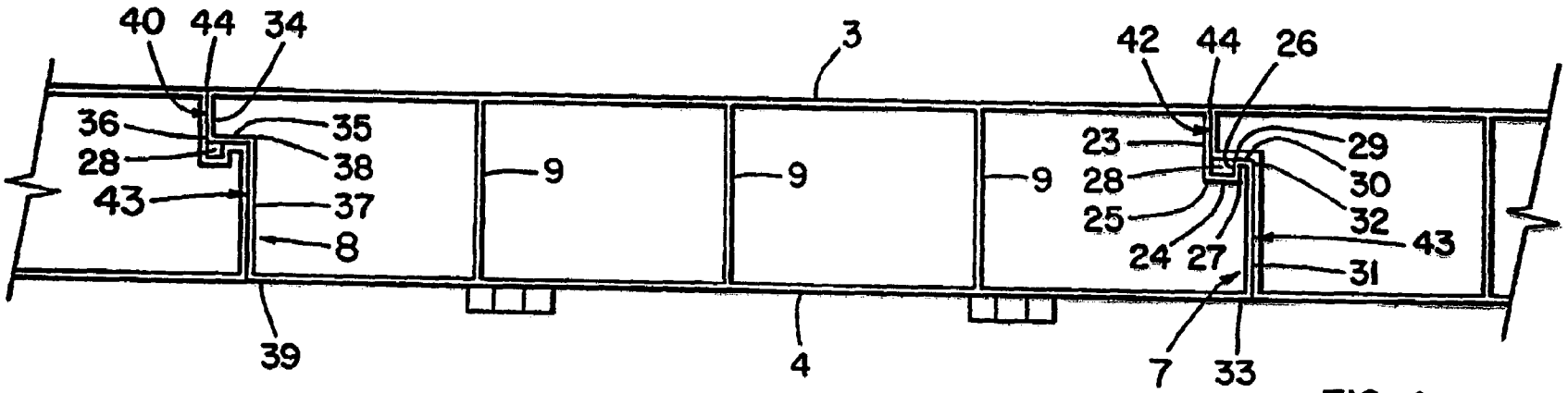
FIG. 4 is an enlarged cross section of the transit boarding platform panel of FIG. 2 along line 4-4 and showing adjacent panels.

With reference to FIG. 4, the interface between adjacent panels 1 utilizes a shiplap configuration. The first side 7 of base section 2 has a top section 42 having a first vertical wall section 23 extending from the top deck 3. A horizontal flange 24 extends outwardly from the base 25 of the vertical wall section 23. A second vertical wall section 26 extends upwards from the exterior edge 27 of flange 25. Extending outwardly from the top 29 of the second vertical wall section 26 is a second flange 30. This effectively creates a drainage channel 28 beneath the joint between adjacent panels. The bottom section 43 of side 7 has third vertical wall section 31 that depends from the outer edge 32 of the second flange 30 and connects to the edge 33 of bottom plate 4.

The other side 8 of the base section 2 has a top section 40 having a first vertical wall section 34 extending from the top deck 3. A horizontal flange 35 extends inwardly from the base 36 of the vertical wall section 34. The bottom section 41 of side 8 has a second vertical wall section 37 depends from the inner edge 38 of the flange 35 and connects to the edge 39 of bottom plate 4. As can be seen in FIG. 4, the top section 40 of second side 8 of one panel overlays the bottom section 43 of side 7 of the adjacent panel. The joint 44 between adjacent panels is sealed preferably with a urethane sealant to prevent moisture from getting between the panels and possibly corroding the support structure. The drainage channel 28 will collect and direct to the edge of the platform any moisture that does manage to penetrate the sealant or if the sealant is damaged by weather or environmental conditions. As shown in FIG. 5 one or more drip holes 45 can be provided in the bottom plate 4 to eliminate any moisture or condensation from within the base section 2.

The panel 1 can be attached to support columns, generally indicated at 46, provided to support the platform. The support columns 46 typically comprise a concrete footing 47 on which a metal I-beam 48 is mounted. The I-beams 48 are usually arranged to support adjacent panels along the length of the platform. To facilitate connection to the I-beam 48, panel 1 is provided with Z clip mounting brackets 49. A metal channel 57 is bonded to the inside 58 of bottom plate 4. Additional support haunches can be provided in the bottom plate if required. The Z clip bracket 49 is connected to channel 57 by machine screws 59 that go into threaded holes 60 in the channel 57. The Z clips 49, channel 57 and screws 59 are preferably stainless steel to resist corrosion. Testing of the panel indicated that the connection clips can withstand a 6000 lb uplift force with minimal 0.01 and 0.03 inches permanent deformation of the clip connection. This is more than adequate to withstand the uplift forces generated by high speed trains.

The base section 2 including the internal longitudinal and cross support members 9,10 are formed of a polymer matrix composite comprising reinforcing fibers and a polymer resin to provide light weight and durability. Suitable reinforcing fibers include glass fibers, including but not limited to E-glass and S-glass, as well as carbon, metal, high modulus organic fibers (e.g., aromatic polyamides, polybenzamidazoles, and aromatic polyimides), and other organic fibers (e.g., polyethylene and nylon). Blends and hybrids of the various fibers can be used. Other suitable composite materials could be utilized including whiskers and fibers such as boron, aluminum silicate and basalt.

The resin material in the base section 2 is preferably a thermosetting resin, and more preferably a vinyl ester resin. The term "thermosetting" as used herein refers to resins which irreversibly solidify or "set" when completely cured. Useful thermosetting resins include unsaturated polyester resins, phenolic resins, vinyl ester resins, polyurethanes, and the like, and mixtures and blends thereof. The thermosetting resins useful in the present invention may be used alone or mixed with other thermosetting or thermoplastic resins. Exemplary other thermosetting resins include epoxies. Exemplary thermoplastic resins include polyvinylacetate, styrene-butadiene copolymers, polymethylmethacrylate, polystyrene, cellulose acetatebutyrate, saturated polyesters, urethane-extended saturated polyesters, methacrylate copolymers and the like.

Polymer matrix composites can, through the selective mixing and orientation of fibers, resins and material forms, be tailored to provide mechanical properties as needed. These polymer matrix composite materials possess high specific strength, high specific stiffness and excellent corrosion resistance. Polymer matrix composite materials, such as a fiber reinforced polymer formed of E-glass and a vinylester resin have exceptionally high strength, good electrical resistivity, weather and corrosion-resistance, low thermal conductivity, and low flammability.

The panels of FIGS. 1 to 8 can be fabricated by hand lay-up or other suitable methods including resin transfer molding (RTM), vacuum curing and filament winding, automated lay-up methods and other methods known to one of skill in the art of composite fabrication and are therefore not described in detail herein. Pultrusion fabrication is not an option where the top deck of the panel is formed with a taper from its midpoint as shown in the figures.

A preferred method of making the panels of the present invention involves the use of vacuum assisted resin transfer injection. The process in general involves first laying down a plurality of glass sheets in a mold. The mold is typically a maximum of 4 to 5 feet wide and up to 15 to 20 feet long. Glass wrapped blocks of foam are then placed on top of the glass sheets. The space between the wrapped foam blocks forms the internal longitudinal and horizontal support members and the space to the edge of the mould forms the side and end walls of the panel. The top surface of the foam blocks is shaped to provide the taper over the length of the panels. If required tubes can be inserted into the mould to form raceways for electrical plumbing or heating elements that may be desired to run along the platform. In addition if there are obstructions such as lampposts on the platform, these can be accommodated in the molding process by framing around the space for the obstruction. Glass sheets are then placed on top of the foam blocks and the lid of the mould closed. A vacuum is applied to the mould to assist as the resin is injected into the mould. After the panel is removed from the mould, the area provided for any obstructions can be cut out in the panel and the foam is not exposed the result is a one-piece panel fully completed in about one hour. This is substantial less time than to form the panel using pultrusions that are individually fastened together with bolts, screws or adhesives.

The panels of the present invention solve the problem of durability and premature breakdown of concrete and wood platforms due to degradation by environmental chemicals such as, salt, urea, acid rain, oil, greases as well as stray electrical currents. The lightweight of the panels facilitates ease of installation in areas that have difficult access and work windows. The panels of the present invention also solve the problem of dealing with heavy concrete platforms (ten times heavier than the present invention) that necessitate the use of costly foundations and steel support systems. These benefits apply to both new and retrofit construction requirements. The panels of the present invention also solve a problem caused by joint expansion and degradation of seal integrity between panels with the provision of positive drainage channels. The drainage channels eliminate corrosive elements penetrating the joint past poorly installed or worn sealant joints which leads to the deterioration of the steel and or concrete structure and foundation. Reduced maintenance and long life cycles are achieved.

Typically the panels of the present invention sit on the grade and don't require the delay required for concrete to cure before they are ready to use. In addition, because the panels are formed to accommodate the detectable tiles there is not need to grind the deck to accommodate them as in the case of poured in place concrete platforms. The lightweight of the panels also enables them to be used on elevated platforms typically using existing structural supports. Assembly of a typical platform installation using the panels of the present invention is completed within a few days as opposed to a number of weeks using other methods.

Figure 9:
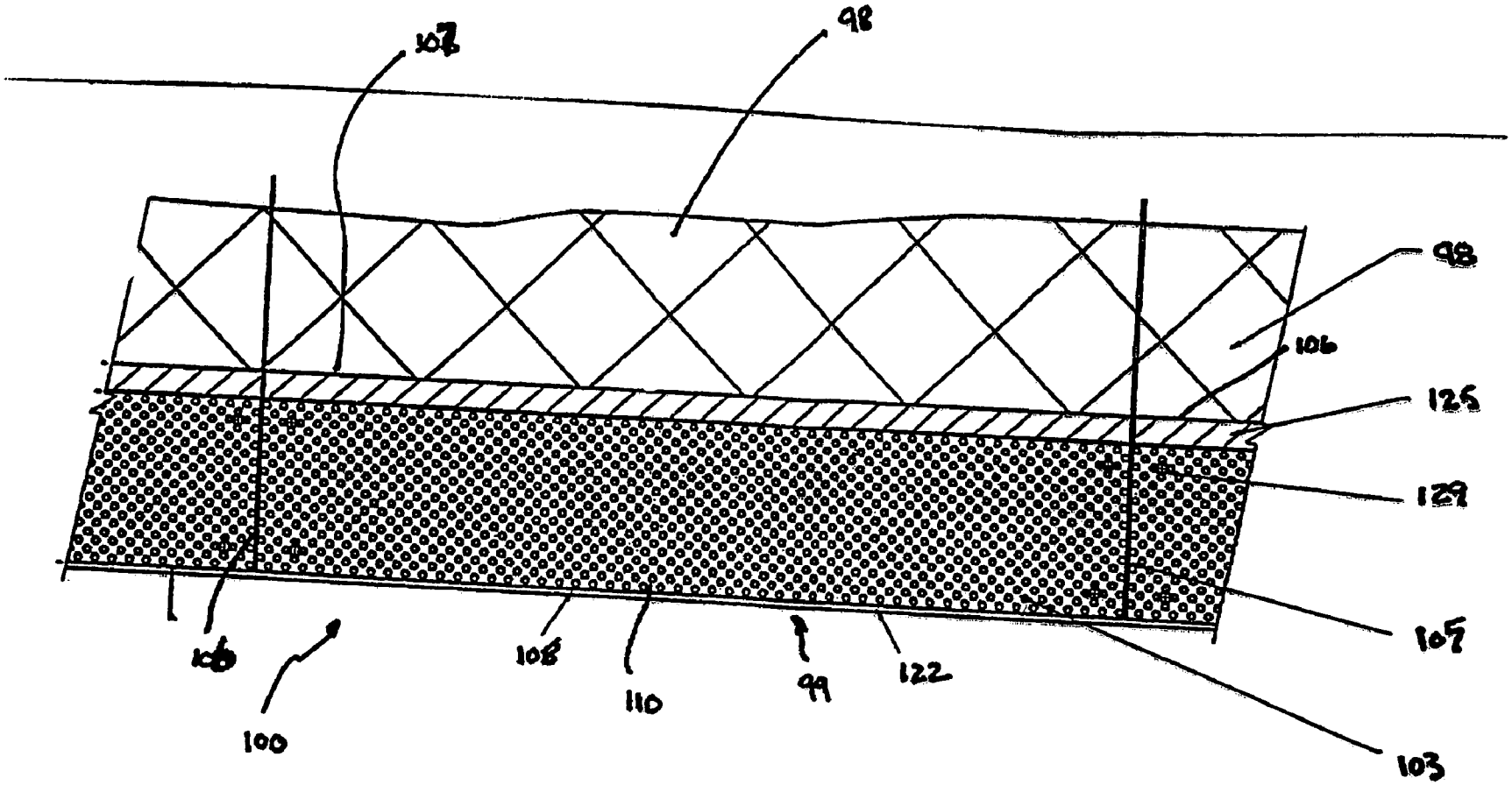
FIG. 9 is a top plan view of another embodiment of a transit boarding platform panel according to the present invention.
Figure 10:
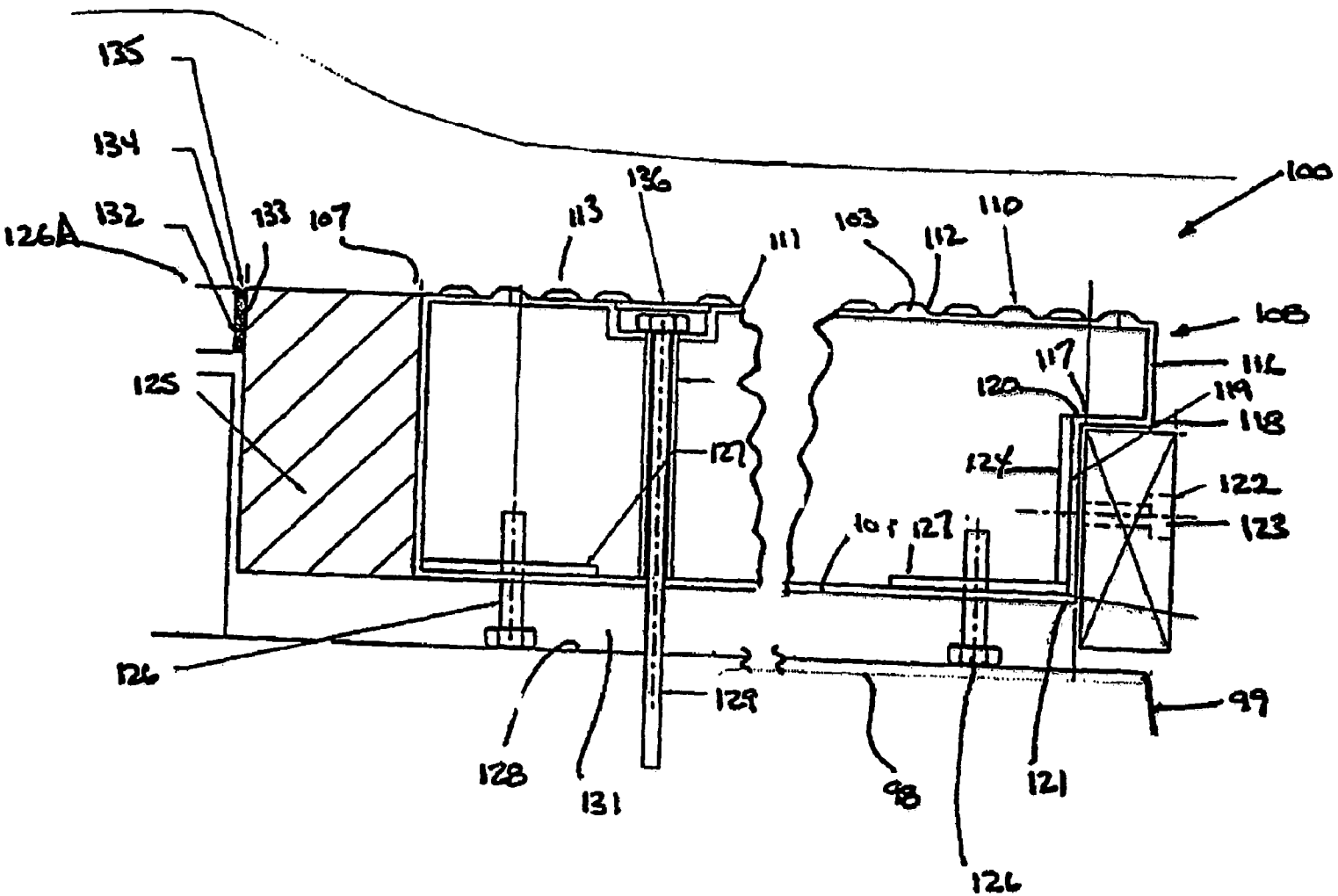
FIG. 10 is an enlarged schematic cross section of the transit boarding platform panel of FIG. 9 through line 10-10.
Figure 11:
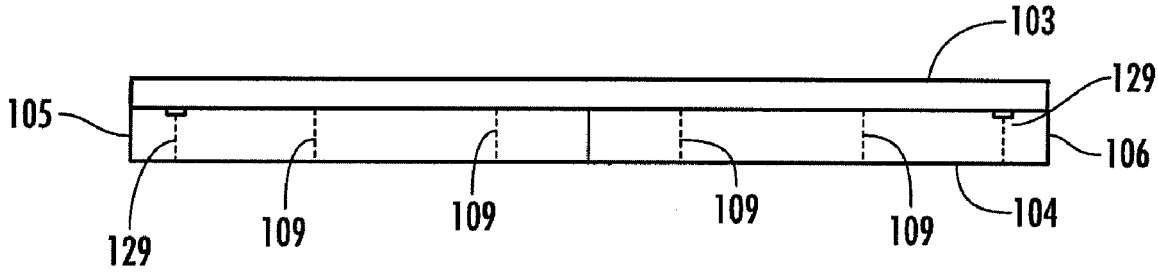
FIG. 11 is a schematic cross section of the transit boarding platform panel of FIG. 9 through line 11-11.

FIGS. 9 to 11, illustrate another embodiment of a panel for use with a transit platform according the present invention is generally indicated at 100. The panel 100 is suitable for use with the retrofit of an existing platform 98 as opposed to the replacement of the entire platform. The panel 100 is designed to fit along the edges 99 of the existing platform 98 adjacent the track (not shown). In the preferred embodiment illustrated the panel 100 is formed from a reinforced composite polymer comprising reinforcing fibers and a polymer resin to provide lightweight and durability. The panel 100 has top deck 103 and bottom plate 104, a first end 105, a second end 106, a first side 107 and second side 108. Between the top deck 103 and bottom plate 104 are a series of internal cross support members 109.

The top deck 103 has detectable warning tiles 110 mounted to or formed integrally with the top surface 111 of the top deck 103.

The detectable warning tiles 111 are similar to the tiles described in previously. The surface 112 of the tiles 110 has plurality of rows of spaced buttons 113 projecting upwardly there from, thereby providing a distinctively textured surface relative to the texture of the surface of the platform. As can be seen in FIGS. 9 and 10, the buttons preferably are circular. Buttons in adjacent rows are offset from each other by one-half of the centerline spacing distance. The buttons 113 have generally flat upper surfaces that have texturing means thereon for creating a palpably rough surface texture. The texturing means in the preferred embodiment is provided by rows of semi-spherical raised dimples arranged in a grid pattern.

The areas between buttons preferably also have texturing means consisting of a plurality of rows of spaced dimples projecting upwardly there from, to provide slip resistance in those areas (e.g. for women in high heels and to improve maneuverability of wheelchairs).

To reduce the possibility of tripping, the height of the buttons in one or more rows adjacent the side 107 of panel 100 is reduced in height and diameter relative to the height and diameter of buttons in subsequent rows, so that there is a gradual increase in height and diameter. Thus in the preferred embodiment the buttons in the first row adjacent the side 107 of panel 100 are only about one-third as high as the other buttons and the buttons in the second row are only about two-thirds as high as the other buttons. Similarly the buttons in the first row have a diameter about 12% less than the other buttons and the buttons in the second row have a diameter about 3% less than the rest of the buttons.

The side 108 of the panel 100 adjacent the track, in the embodiment shown, is adapted to receive means to protect the panel 100 from damage. In the embodiment shown, side 108 of panel 100 has a first vertical wall section 116 extending from the top deck 103. A horizontal flange 117 extends inwardly from the base 118 of the vertical wall section 116. A second vertical wall section 119 depends from the inner edge 120 of the flange 117 and connects to the edge 121 of bottom plate 104. The means to protect the panel 100 comprises a plurality of bumpers 122 fastened to the second wall section 119. Bumpers 122 are of sufficient thickness that they extend past the base 118 of the first vertical wall section 116 and in the preferred embodiment is a single bumper the length of the panel and formed of polypropylene. The bumpers 122 are fastened to the panel 100 by means of bolts 123 that thread into plates 124 embedded in panel 100.

The side 107 of panel 107, in the embodiment shown, is adapted to provide a visual and sound contrast to the top deck 103 of panel 100 that is preferably made of yellow thermoset glass-reinforced plastic composite material. In the embodiment shown a black granite strip 125 is integrated with the panel 100 to provide a visual and cane-on-contact sound contrast to both panel 100 and the surrounding platform surface 126A which is typically poured in place concrete or pavers.

As noted earlier panel 100 is typically utilized in a retrofit application to an existing platform. To install the panel 100, leveling bolts 126 are fastened to the bottom plate 104 by threading into reinforcing plates 127 formed into panel 100. The leveling bolts 126 are used to level the panel 100 on the surface 128 of the existing platform 98 on which the panel is being installed. Threaded rods 129 are inserted through tubes 130 in the panel 100 and screwed into the existing platform 98. To provide additional stability and support a grout bed 131 can be placed on the existing platform surface beneath the bottom plate 104. Alternatively two of the rods 129 can be inserted through holes in the granite strip 125 to fasten the second end 107 of panel 100 to the platform.

At the end 107 of the panel 100 remote from the edge 99 of the platform 98, the space between the panel 100 and the platform is filled with material to prevent moisture from penetrating the seam. In the embodiment shown a premolded joint filler 132 is inserted into the joint 133. A closed cell foam backer rod 134 is inserted next and then topped off with a self leveling urethane sealant 135.

A cap 136 is bonded with a structural adhesive over the rods 129.

It will be appreciated that a wide range of dimensions may be suitable for the panel 100. The panel 100 of the preferred embodiment shown in the drawings has nominal dimensions of 10 feet long by about 2 feet 4 inches in width. The panel has a nominal thickness of 6.5 inches and the panel plus leveling blots have a nominal height of 8 inches. The weight of the preferred embodiment is substantially less than the weight of standard precast concrete panels currently in use. Accordingly they can be used on elevated platforms typically using existing structural supports. Assembly of a typical platform installation using the panels of the present invention is completed within a few days as opposed to a number of weeks using other methods. The panels of the present invention were tested for vibration and load to test the ability of the panel to withstand the uplifting forces caused by passing rail traffic and the load bearing characteristics of the panel. Vibration tests on the preferred embodiment indicated vibration amplitudes below the human threshold of perception and comparable to results for pre-cast concrete platforms.

Figure 12:
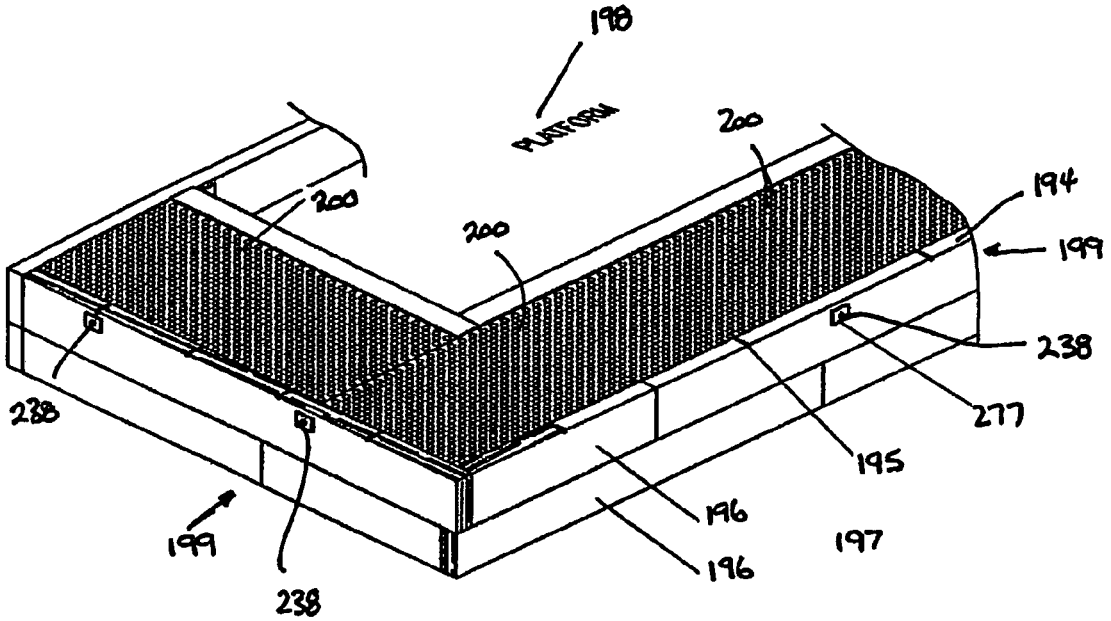
FIG. 12 is a front perspective view of the end of a transit boarding platform incorporating another embodiment of a transit boarding platform panel according to the present invention.
Figure 13:
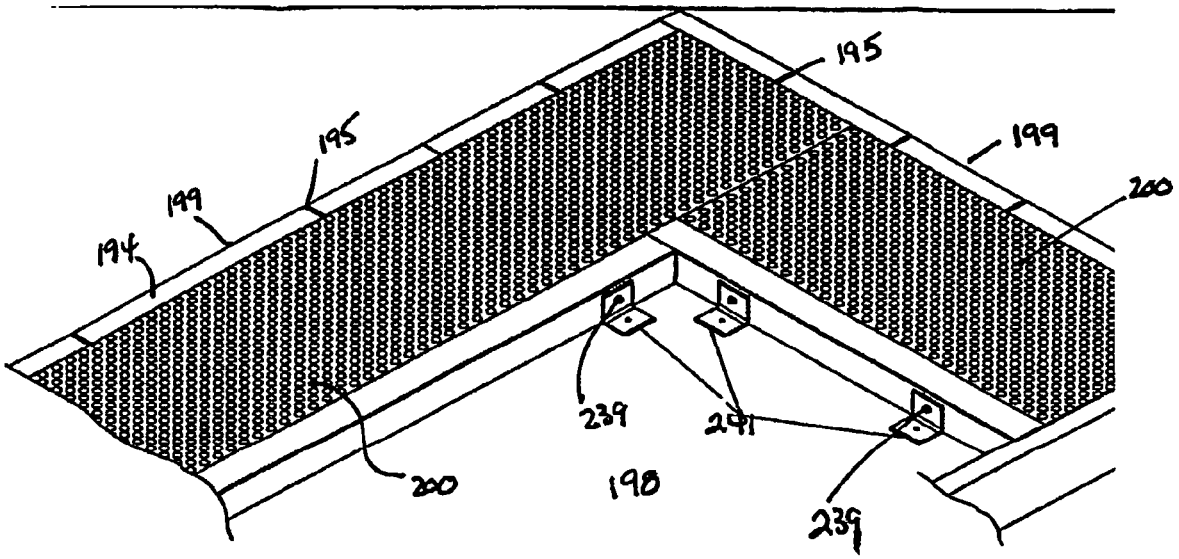
FIG. 13 is a rear perspective view of a corner of a transit boarding platform incorporating the transit boarding platform panel of FIG. 12.

FIGS. 12 to 22 illustrates another embodiment of a panel for use with a transit platform according the present invention generally indicated at 200. The panel 200 is suitable for use with an existing or new platform 198 at grade. A plurality of panels 200 is designed to fit along the edges 199 of the platform 198 adjacent the track 197 (see FIG. 12). The edges 199 of the platform are framed by treated wooden headers 196. In FIG. 12, two rows of wooden headers 196 are illustrated. The bottom row of wooden headers are preferably 4"×10" creosote treated wooden headers and the top row are preferably 4"×12" creosote treated wooden headers. A plurality of drainage notches 195 is cut into the top surface 194 of the top row of wooden headers 196.

Figure 14:
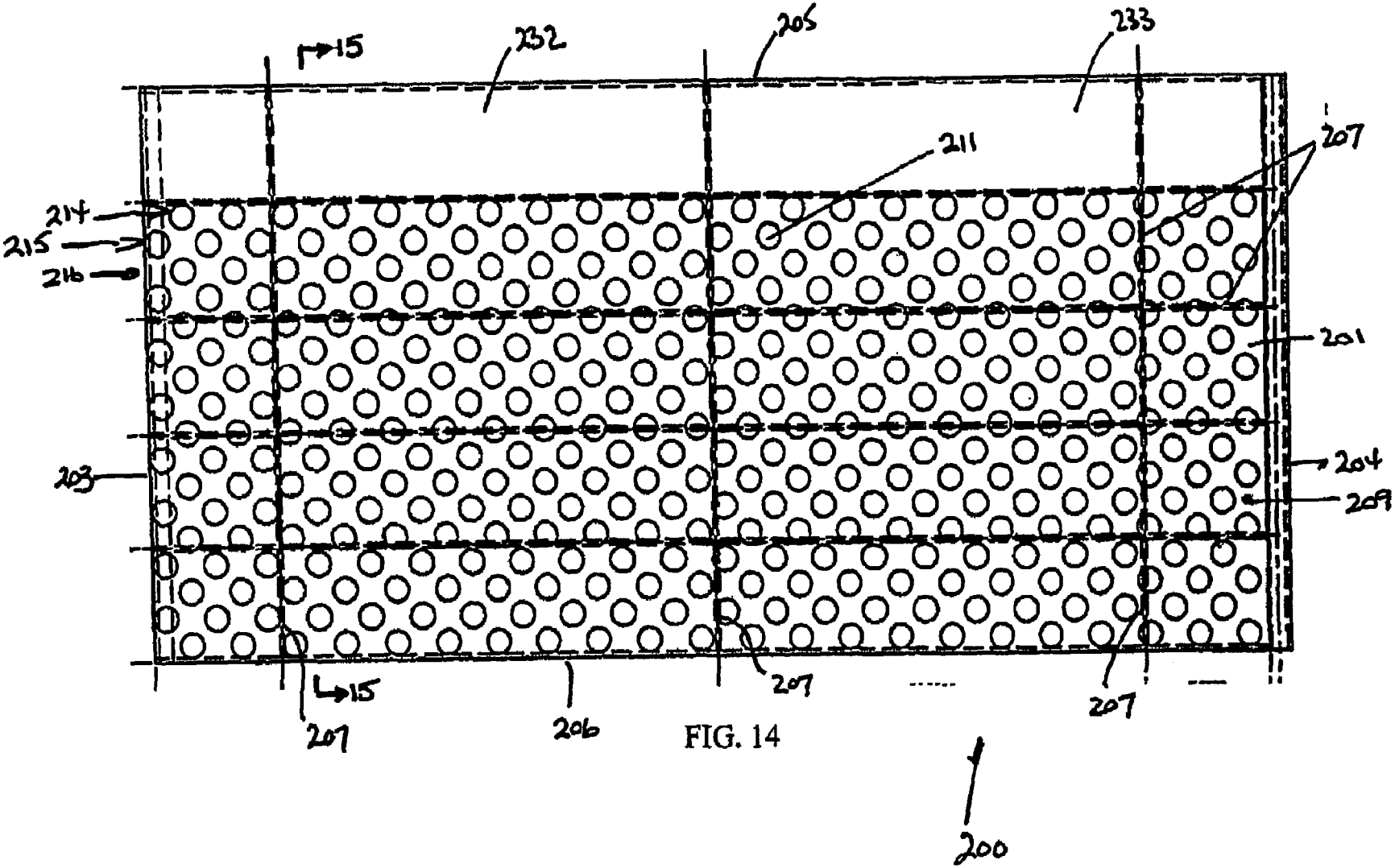
FIG. 14 is a top plan view of the transit boarding platform panel of FIGS. 12 and 13.
Figure 15:
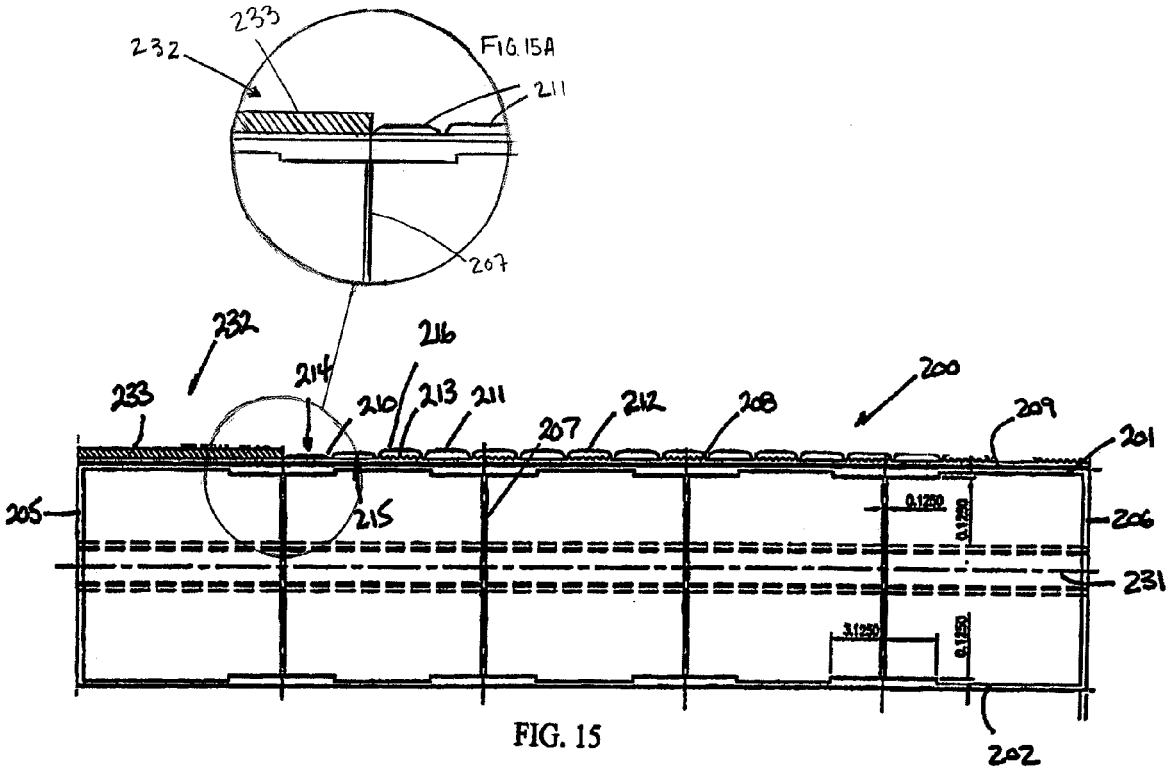
FIG. 15 is an enlarged schematic cross section of the transit boarding platform panel of FIG. 14 through line 15-15.
Figure 16:
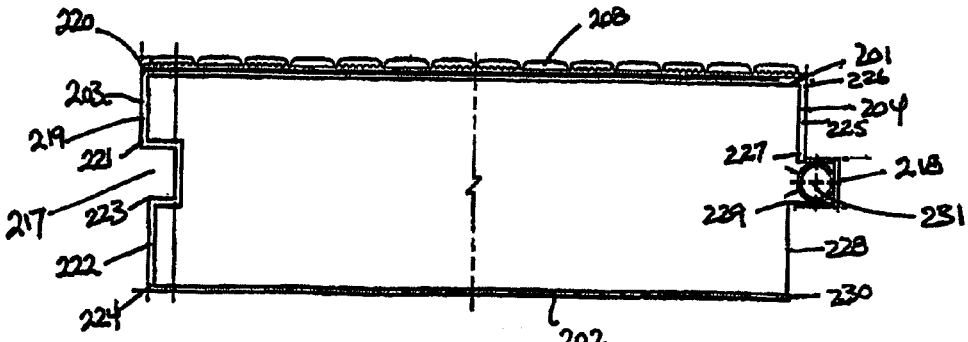
FIG. 16 is an enlarged schematic partial cross section of the transit boarding platform panel of FIG. 14 through line 16-16.

In the embodiment illustrated, the panels 200 are formed from a reinforced composite polymer comprising reinforcing fibers and a polymer resin to provide lightweight and durability. As best shown in FIGS. 14-16, a panel 200 has a top deck 201 and a bottom plate 202, a first end 203, a second end 204, a first side 205 and second side 206. Between the top deck 201 and bottom plate 202 are a series of internal cross support members 207. In the embodiment illustrated the internal cross support members 207 are reinforced composite I beams. Other configurations and spacing of internal cross support members are possible and within the scope of the present invention.

The top deck 201 has detectable warning tiles 208 mounted to or formed integrally with the top surface 209 of the top deck 201. The detectable warning tiles 208 are similar to the tiles described previously and comply with the ADA Guidelines. The surface 210 of the tiles 208 has a plurality of rows of spaced buttons 211 projecting upwardly there from, thereby providing a distinctively textured surface relative to the texture of the surface of the platform. As can be seen in FIG. 14, the buttons 211 preferably are circular. Buttons 211 in adjacent rows are shown offset from each other by one-half of the centerline spacing distance although they could also be aligned. The buttons 211 preferably have generally flat upper surfaces that have texturing means thereon for creating a palpably rough surface texture. The texturing means in the preferred embodiment is provided by rows of semi-spherical raised dimples 212 arranged in a grid pattern. The areas between buttons preferably also have texturing means consisting of a plurality of rows of spaced dimples 213 projecting upwardly there from, to provide slip resistance in those areas (e.g. for women in high heels and to improve maneuverability of wheelchairs). To reduce the possibility of tripping (as shown in FIG. 15), the height of the buttons in one or more rows 214, 215 adjacent the side 205 of panel 200 may be reduced in height and diameter relative to the height and diameter of buttons in subsequent rows 216, so that there is a gradual increase in height and diameter. Thus in the embodiment illustrated the buttons in the first row 214 adjacent the side 205 of panel 200 are only about one-third as high as the other buttons in rows 216 and the buttons in the second row 215 are only about two-thirds as high as the other buttons in rows 216. Similarly the buttons in the first row may have a diameter about 12% less than the other buttons and the buttons in the second row may have a diameter about 3% less than the rest of the buttons.

The first and second ends 203,204 of the panel 200 are provided with means to interconnect adjacent panels and to secure the panels 200 to the platform. As shown in FIG. 16, the first end 203 of each panel 200, in the embodiment illustrated, is provided with a groove 217 sized and shaped to accept a corresponding sized and shaped tongue 218 on the second end 204 of an adjacent panel. In the embodiment shown the first end 203 has a first vertical wall section 219 depending from the top deck 201. The first vertical wall section 219 has a top edge 220 and a bottom edge 221. A second vertical wall section 222 extends upwardly from the bottom plate 202. The second vertical wall section 222 has a top edge 223 and a bottom edge 224. The second vertical wall section 222 is preferably offset inwardly from the first vertical wall section 219. Groove 217 is located between the bottom edge 221 of the first vertical wall section 219 and the top edge 223 of the second vertical wall section 222 and runs the entire width of the first end 203.

Similarly the second end 204 has a first vertical wall section 225 depending from the top deck 201. The first vertical wall section 225 has a top edge 226 and a bottom edge 227. A second vertical wall section 228 extends upwardly from the bottom plate 202. The second vertical wall section 228 has a top edge 229 and a bottom edge 230. The second vertical wall section 228 is preferably offset inwardly from the first vertical wall section 225. Tongue 218 is located between the bottom edge 227 of the first vertical wall section 225 and the top edge 229 of the second vertical wall section 228 and runs the entire width of the second end 204. A bolt hole 231 is aligned along the longitudinal axis of and within tongue 218. In the embodiment shown the groove 217 and tongue 218 have a generally rectangular configuration.

While the tongue and groove method of interconnecting adjacent panels is illustrated other methods are possible including the shiplap connection shown in FIGS. 1-6 or the end of the panels can be planar. All such methods are within the scope of the present invention.

The portion 232 of the top surface 209 of the top deck 201 adjacent side 205, in the embodiment shown, is adapted to allow snow removal without damaging the raised truncated buttons 211. As best shown in FIG. 15A, the surface 233 of portion 232 of the top deck 201 adjacent side 205 is slightly above the height of the buttons 211. Preferably a polymer concrete material is used to raise portion 232 of the top surface 209 of the top deck 201 to the desired height. In the preferred embodiment the polymer concrete is a ¼" thick epoxy and granite mixture that also provide a visual and sound contrast to the top deck 201 of panel 200. The top deck 201 of panel 200, as noted above, is preferably made of thermoset glass-reinforced plastic composite material preferably yellow. In the embodiment shown a black granite/epoxy strip 233 is integrated with the panel 200 to provide a visual and cane-on-contact sound contrast to both panel 200 and the surrounding platform surface 198 which is typically asphalt, poured in place concrete or pavers.

As noted earlier panel 200 is typically utilized in new or retrofit applications to an existing platform. To install the panels 200, the first step is to set a sub-base of engineered granular fill (crushed stone). Next the timber headers 196 are laid out to form a retaining wall and the platform (as opposed to the location of the panels 200) staked in. The area where the panels 200 are to go is filled with compacted granular fill. Panels 200 are installed with the tongue 218 inserted into the groove 217 of the adjacent panel. Then a hole 235 is drilled through timber header 196 opposite the opening in bolt hole 230 in tongue 218. Hole 235 is located so the top surface 194 of timber header 196 will be slightly above the height of the buttons 211 on the top deck 201 of panels 200. This allows the blade of snow removal equipment to rest on the top surface 195 of timber header 196 and strip 233 without touching or damaging buttons 211. A threaded rod 234 is inserted through the hole 235 in timber header 196 and through bolt hole 230 in tongue 218. An end plate 236 and nut 237 are fastened on the end 238 of rod 234 projecting through the side of timber header 196. The other end 239 of rod 234 is connected to the upstanding angle 240 of bracket 241 and fastened by nut 242 and washer 243. A hole 244 in the base 245 of bracket 241 through which an anchor (not shown) can be inserted can be used to anchor the bracket to the adjacent platform. The area beyond side 205 of panels 200 can then be filled with the appropriate platform materials whether fill and asphalt, pavers or concrete. The top portion of joint 246, above tongue 218 between adjacent panels 200, can be filled with appropriate filler, preferably a pre-molded joint filler and then topped off with a self-leveling urethane sealant. The space between the second vertical wall sections 222, 228 of adjoining panels 200 acts a drainage channel.

Where the tongue and groove connection is not used, bolt hole 230 can be relocated to pass through panel 200 from the first side 205 to the second side 206.

The use of panels 200 has a number of advantages over known systems where detectable tiles are mounted to a concrete platform including:

- There are no weather limitations to installation of the panels 200 thereby extending construction season by up to six months in colder climates.
- Use of panels 200 eliminates the costly and time-consuming requirement to pour concrete to establish a transit platform edge at grade, suitable to receive a detectable warning surface tile.
- A transit platform edge, at grade, using panels 200 that incorporate a factory installed detectable warning surface tile expedites the construction of a platform edge because of the factory prefabrication.
- Panels 200 are impervious to salt and chemical snow melting systems and are chemical resistant to oils, greases, detergents and other chemicals present in a transit environment.
- Panel 200 is structural in it's ability to permit snow clearing with conventional snow clearing equipment, as they are able to withstand the significant dynamic loads applied by this type of equipment.
- Panels 200 are preferably modular to reduce the necessity of field cutting to allow for various lengths of platforms, wider crossing areas, and return ends to accommodate a wider detectable warning surface tile.

Panels 200 are interconnected with an integral tongue and groove system which has a passage hole in the tongue for a through bolt to the timber or plastic retaining wall edge. The tongue and groove panel system ensures that each panel is level to each other and the through bolt ensures the panels are level to the timber or plastic retaining wall edge. The through bolt also has an integral angle to lock the panels to the platform surface behind, whether it is asphalt, concrete or brick pavers.

Panels 200 have an integral polymer concrete strip 233 which has a height just above the truncated domes on the detectable warning tile surface tile to allow snow removal equipment to scrape along the polymer concrete and timber edge, avoiding damage to the raised truncated domes.

Panel 200 is lightweight and corrosion resistant and can be installed quickly, as compared to a pre-cast concrete edge. The system has a factory applied or integral detectable warning surface and is tongue and groove and connects or ties into the adjacent platform edge materials.

The platform length can be easily expanded or reduced or panels 200 can be used as a quick temporary platform in emergency situations or during construction of a permanent station.

Conventional concrete platform construction is costly and time consuming to construct as it typically involves the following procedures:

1: Set a sub-base of engineered granular fill (crushed stone).
2: Lay out timber retaining wall and stake in platform.
3: Fill in retaining wall area with compacted granular fill.
4: Accurately (difficult procedure) set concrete forms to create a platform edge wide enough to receive a detectable warning surface.
5: Pour concrete and accurately trowel to a smooth surface.
6: Remove concrete forms, and wait one to two weeks for concrete to cure. Demobilization from project site is normally involved at this point.
7: Schedule a cutting and grinding contractor to cut grooves and recess, protecting ballast and adjacent areas from fouling due to the slurry generated in this operation. Remobilization from project site is normally involved at this point
8: After concrete has cured a full 30 days, detectable warning surface can be field applied with adhesive and fasteners and caulking (operation limited by rain, cold weather, snow etc.)

Estimated Time of Construction—Three Months

Figure 21:
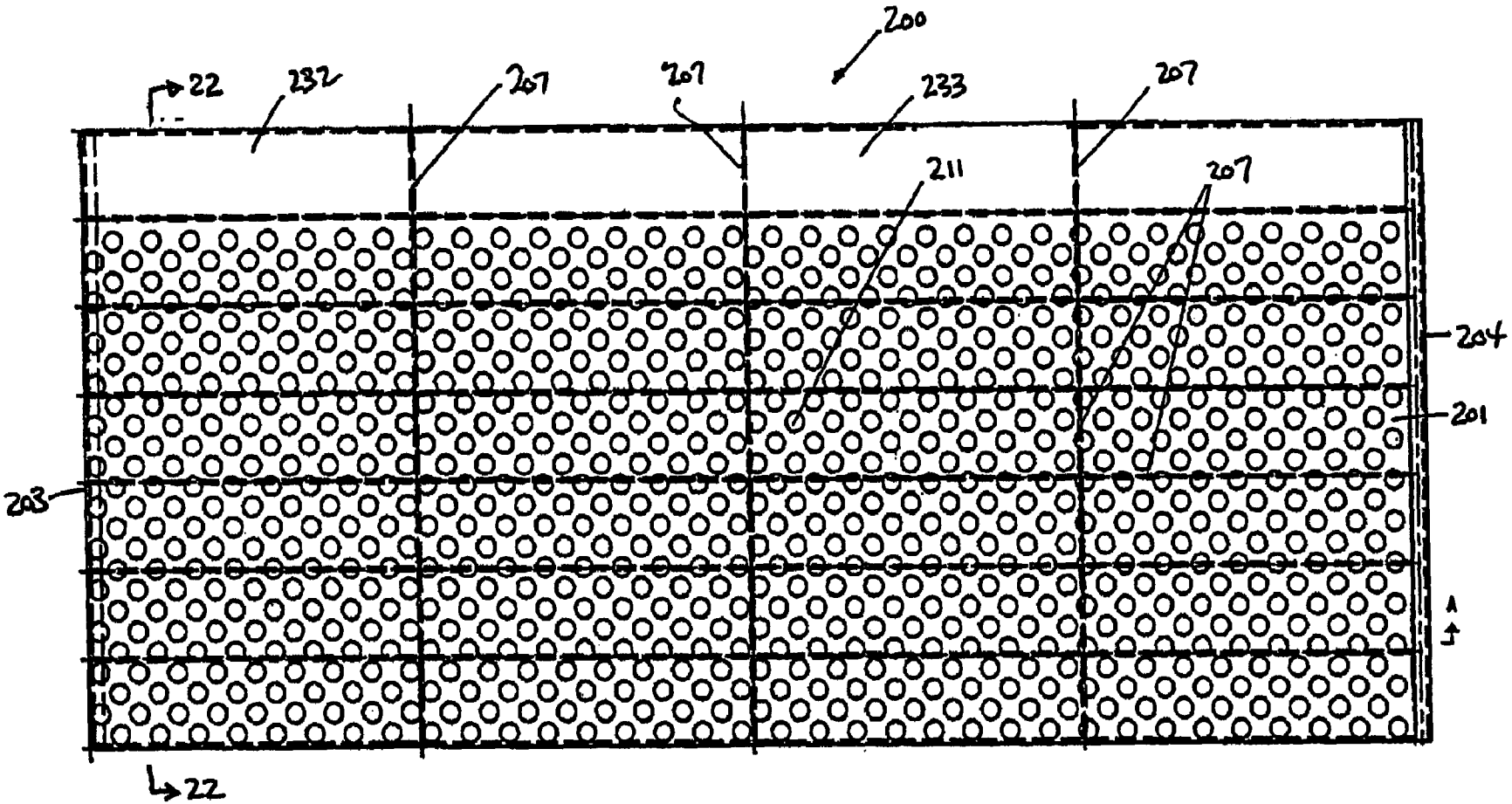
FIG. 21 is a top plan view of another embodiment of the transit boarding platform panel according to the present invention.
Figure 22:
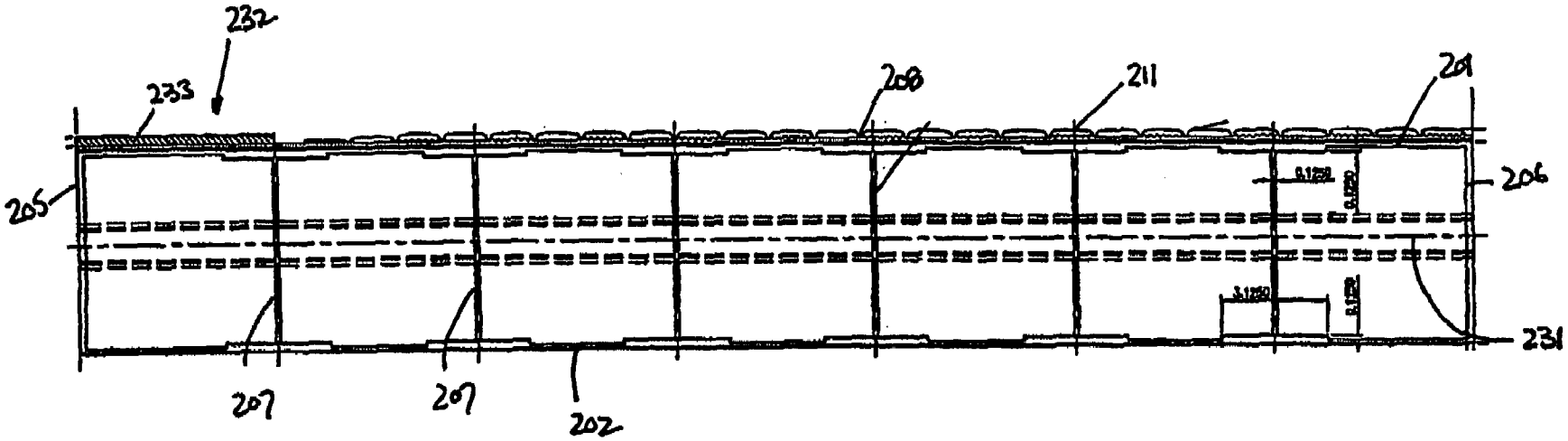
FIG. 22 is an enlarged schematic cross section of the transit boarding platform panel of FIG. 21 through line 22-22.

In contrast using the panels 200 of the present invention construction is simplified and typically involves the following procedures:

1: Set a sub-base of engineered granular fill (crushed stone).
2: Lay out timber retaining wall and stake in platform.
3: Fill in retaining wall area with compacted granular fill.
4: Install structural plastic transit platform edge as described above Estimated Time of Construction—Three Weeks It will be appreciated that a wide range of dimensions may be suitable for the panels 200. In the preferred embodiment panels 200 are provided in a variety of standard sizes so the system is modular and minimizes the need for cutting in the field. For example the panel shown in FIGS. 14 and 15 has nominal dimensions of 62 inches long by about 30 inches in width. The panel has a nominal thickness of 6.1 inches. In FIGS. 21 and 22 the panel has nominal dimensions of 95.75 inches long by about 30 inches in width.

As noted above the panels 1, 100 and 200 can be fabricated by hand lay-up or other suitable methods including resin transfer molding (RTM), vacuum curing and filament winding, automated lay-up methods and other methods known to one of skill in the art of composite fabrication and are therefore not described in detail herein. Pultrusion fabrication is not an option for the panels 1 where the top deck of the panel is formed with a taper from its midpoint as shown in the FIGS. 1-8. A preferred method of making the panels of the present invention involved the use of vacuum assisted resin transfer injection. Where panels 100 and 200 are used at grade, problems maybe encountered with frost forming on the top surface of the top deck in colder climates. To minimize frost problems, an open honeycomb polyethylene block or other means to provide a thermal conduit between the ground and the top surface of the panel may be utilized. The bottom plate 104, 202 of panel 100, 200 for example can contain openings (not shown) to provide thermal conduits between the ground, through any honeycombed blocks or other support material to the top deck 103, 201.

Having illustrated and described preferred embodiments of the invention and certain possible modifications thereto, it should be apparent to those of ordinary skill in the art that the invention permits of further modification in arrangement and detail. Variations in design are possible due to the flexibility and relative low cost of tooling used in the manufacturing process. Panel size, length, width, thickness, color, ribbing and surface profiles can be modified to suit specific project requirements. Drainage details can be modified to suit specific project requirements. Additional benefits of the present invention are the improved ability for the system to incorporate heat tracing systems for cold climates and electrical raceways for lighting and communication systems that can be integral to the panel. All such modifications are covered by the scope of the invention.

What is claimed is:

1. A transit boarding platform panel for use along an edge of a transit platform adjacent a track, said panel comprising a molded base portion formed from a reinforced composite polymer, said base portion comprising:

a top deck and bottom plate, a first side intended to be adjacent a track at an edge of the transit platform, a second side opposite said first side and intended to be adjacent the transit platform, a first end defining a groove, and a second end defining a tongue dimensioned to be received by the groove and having a longitudinal axis, the tongue including a hole extending along the longitudinal axis, and a series of internal support members between the top deck and the bottom plate, wherein said top deck includes a detectable warning surface consisting of raised truncated domes detectable by the visually impaired in accordance with Americans with Disabilities Act (ADA): Accessibility Guidelines for Buildings and Facilities, a portion of the top surface of the top deck adjacent said second side adjacent the transit platform is slightly above the height of the truncated domes to allow snow removal without damaging the raised truncated domes on said detectable warning surface.

2. A transit boarding platform panel according to claim 1 wherein edges of the transit platform adjacent the track are framed by one or more headers.

3. A transit boarding platform panel according to claim 1 wherein the first end of said panel has a first vertical wall section depending from the top deck said first vertical wall section having a top edge and a bottom edge, a second vertical wall section extends upwardly from the bottom plate of said panel, said second vertical wall section having a top edge and a bottom edge wherein the second vertical wall section is offset inwardly from the first vertical wall section and wherein the groove is located between the bottom edge of the first vertical wall section and the top edge of the second vertical wall section and runs the entire width of the first end.

4. A transit boarding platform panel according to claim 3 wherein the second end of said panel has a first vertical wall section depending from the top deck said first vertical wall section having a top edge and a bottom edge, a second vertical wall section extends upwardly from the bottom plate said second vertical wall section having a top edge and a bottom edge wherein the second vertical wall section is offset inwardly from the first vertical wall section and wherein the tongue is located between the bottom edge of the first vertical wall section and the top edge of the second vertical wall section and runs the entire width of the second end.

5. A transit boarding platform panel according to claim 1, further comprising a strip integrated with the portion of the top surface of the top deck adjacent said second side adjacent the transit platform to provide a visual and cane-on-contact sound contrast to both panel and the surrounding platform surface.

6. The transit boarding platform panel of claim 2, wherein the header extends along the first side of the transit boarding platform panel.

7. The transit boarding platform panel of claim 6, wherein the header defines an opening coaxial with the hole.

8. The transit boarding platform panel of claim 7, further comprising a threaded rod extending through the hole and the opening.

9. The transit boarding platform panel of claim 8, further comprising a bracket that connects with the threaded rod affixed to the second side of the transit boarding platform panel.

10. A transit boarding platform panel for use along an edge of a transit platform adjacent a track, said panel comprising a molded base portion formed from a reinforced composite polymer, said base portion having a top deck and bottom plate, a first side intended to be adjacent a track at an edge of the transit platform, a second side opposite said first side and intended to be adjacent the transit platform, a first end and a second end, and between the top deck and bottom plate a series of internal support members, said top deck having a detectable warning surface consisting of raised truncated domes detectable by the visually impaired in accordance with Americans with Disabilities Act (ADA): Accessibility Guidelines for Buildings and Facilities, wherein the first and second ends are provided with means to interconnect adjacent panels and to secure the panels to the platform, a portion of the top surface of the top deck adjacent said second side adjacent the transit platform is slightly above the height of the truncated domes to allow snow removal without damaging the raised truncated domes on said detectable warning surface, wherein edges of the transit platform adjacent the track are framed by one or more headers, the means to interconnect adjacent panels and to secure the panels to the platform includes a groove provided on the first end of each panel, said groove sized and shaped to accept a corresponding sized and shaped tongue provided on the second end of an adjacent panel, the first end of said panel has a first vertical wall section depending from the top deck said first vertical wall section having a top edge and a bottom edge, a second vertical wall section extends upwardly from the bottom plate of said panel, said second vertical wall section having a top edge and a bottom edge wherein the second vertical wall section is offset inwardly from the first vertical wall section and wherein the groove is located between the bottom edge of the first vertical wall section and the top edge of the second vertical wall section and runs the entire width of the first end, the second end of said panel has a first vertical wall section depending from the top deck said first vertical wall section having a top edge and a bottom edge, a second vertical wall section extends upwardly from the bottom plate said second vertical wall section having a top edge and a bottom edge wherein the second vertical wall section is offset inwardly from the first vertical wall section and wherein the tongue portion located between the bottom edge of the first vertical wall section and the top edge of the second vertical wall section and runs the entire width of the second end, and a bolt hole is aligned along a longitudinal axis of and within said tongue portion.

11. A transit boarding platform panel used at grade comprising a molded base portion formed from a reinforced composite polymer, said base portion comprising:

a top deck and bottom plate, a first side intended to be adjacent a track at an edge of the transit platform, a second side opposite said first side and intended to be adjacent the transit platform, a first end defining a groove, and a second end defining a tongue dimensioned to be received by the groove and having a longitudinal axis, the tongue including a bolt hole extending along the longitudinal axis, and a series of internal support members between the top deck and the bottom plate, wherein said top deck includes a detectable warning surface consisting of raised truncated domes detectable by the visually impaired in accordance with Americans with Disabilities Act (ADA): Accessibility Guidelines for Buildings and Facilities, a portion of the top surface of the top deck adjacent said second side adjacent the transit platform is slightly above the height of the truncated domes to allow snow removal without damaging the raised truncated domes on said detectable warning surface, and wherein to minimize frost forming on the top surface of the top deck in colder climates, a thermal conduit is provided between the ground and the top surface of the panel.

12. The transit boarding platform panel of claim 11, wherein the thermal conduit comprises an open honeycomb polyethylene block.

* * * * *